US006874704B2

(12) United States Patent
Mack et al.

(10) Patent No.: US 6,874,704 B2
(45) Date of Patent: Apr. 5, 2005

(54) FUEL-INJECTION VALVE FOR INTERNAL COMBUSTION ENGINES

(75) Inventors: Gerhard Mack, Stuttgart (DE); Taner Narin, Bamberg (DE); Holger Rapp, Hemmingen (DE); Ulrich Kunzi, Winnenden (DE); Ralf Heinecke, Freiberg/N. (DE); Wilhelm Christ, Ludwigsburg (DE); Friedrich Boecking, Stuttgart (DE); Wolfgang Fleiner, Stuttgart (DE); Manfred Fink, Breitenguessbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/296,584

(22) PCT Filed: Mar. 26, 2002

(86) PCT No.: PCT/DE02/01094

§ 371 (c)(1),
(2), (4) Date: Apr. 11, 2003

(87) PCT Pub. No.: WO02/077442

PCT Pub. Date: Oct. 3, 2002

(65) Prior Publication Data

US 2003/0155441 A1 Aug. 21, 2003

(30) Foreign Application Priority Data

Mar. 28, 2001 (DE) ..... 101 15 215

(51) Int. Cl.[7] ..... F02M 59/00

(52) U.S. Cl. ..... 239/533.2; 239/533.3; 239/533.11; 239/533.12

(58) Field of Search ..... 239/533.2, 533.11, 239/533.12, 533.3

(56) References Cited

U.S. PATENT DOCUMENTS

| | | | | |
|---|---|---|---|---|
| 4,151,958 A | * | 5/1979 | Hofmann | 239/533.3 |
| 6,467,702 B1 | * | 10/2002 | Lambert et al. | 239/533.12 |
| 6,616,070 B1 | * | 9/2003 | Kunkulagunta | 239/533.12 |

FOREIGN PATENT DOCUMENTS

| | | |
|---|---|---|
| DE | 20 30 445 | 1/1972 |
| JP | 11280588 | 10/1999 |
| JP | 11294301 | 10/1999 |
| WO | WO 99/19616 | 4/1999 |

* cited by examiner

*Primary Examiner*—Dinh Q. Nguyen
(74) *Attorney, Agent, or Firm*—Ronald E. Greigg

(57) ABSTRACT

A fuel injection valve for internal combustion engines having a valve body in which a bore is embodied, a valve seat face, at least one injection opening embodied on the end toward the combustion chamber of the bore, and at least one injection opening connecting the bore with the combustion chamber of the engine. A nozzle needle is longitudinally displaceably guided in the bore and on its end toward the combustion chamber it has a sealing face, which cooperates with the valve seat face and thus controls the at least one injection opening. The nozzle needle has a central longitudinal bore, in which an inner needle is disposed that is fixed immovably relative to the valve body. The nozzle needle is guided over at least part of its length on the inner needle, so that the nozzle needle is kept exactly centrally in the bore at all times.

6 Claims, 4 Drawing Sheets

FUEL-INJECTION VALVE FOR INTERNAL COMBUSTION ENGINES

CROSS-REFERENCE TO RELATED APPLICATIONS

This application is a 35 USC 371 application of PCT/DE 02/01094, filed on Mar. 26, 2002.

BACKGROUND OF THE INVENTION

1. Field of the Invention

This invention is directed to an improved fuel injection valve for internal combustion engines.

2. Description of the Prior Art

A fuel injection valve for internal combustion engines of the kind with which this invention is concerned is known for instance from German Patent Disclosure DE 43 03 813 A1. A fuel injection valve of this kind has a valve body, in which a bore is embodied on whose end toward the combustion chamber a valve seat face and at least one injection opening are embodied. A pistonlike nozzle needle is disposed longitudinally displaceably in the bore and is guided sealingly in the bore in a portion remote from the combustion chamber. The nozzle needle tapers toward the combustion chamber, forming a pressure shoulder, and on its end toward the combustion chamber it changes over into a valve sealing face that cooperates with the valve seat face and thus by means of the longitudinal motion of the nozzle needle opens and closes the at least one injection opening. At the level of the pressure shoulder, a radial enlargement of the bore forms a pressure chamber, which continues, surrounding the nozzle needle, in the form of an annular conduit as far as the valve seat face. On its end remote from the combustion chamber, the nozzle needle is acted upon by a closing force exerted in the direction of the valve seat. At the same time, a hydraulic force acts on the nozzle needle counter to this closing force, which because of the fuel pressure in the pressure chamber and the attendant hydraulic force is exerted on the pressure shoulder.

In the substantially conical valve seat face, generally a plurality of injection openings are distributed uniformly over the circumference of the valve body. For uniform injection through all of these injection openings, it is important that in the opening motion of the nozzle needle, the nozzle needle and thus also the substantially conical valve sealing face remain precisely central relative to the bore and thus to the valve sealing face, so that a uniform flow of fuel out of the pressure chamber to the injection openings can be accomplished. Since the nozzle needle is now guided in the bore on the portion remote from the combustion chamber, once the valve sealing face lifts from the valve seat face, there is a very long free length of the nozzle needle between the guided portion and the valve seat face, so that it can easily happen that the nozzle needle will become tilted in the bore, resulting in an uneven inflow of fuel to the injection openings. Precisely at the beginning of the opening stroke motion when there is only a very small gap between the valve sealing face and the valve seat face, such tilting has a major influence on the injection pattern and hence on the quality of combustion.

SUMMARY AND ADVANTAGES OF THE INVENTION

The fuel injection valve of the invention has the advantage over the prior art that the nozzle needle is guided by an inner needle, so that exact centering in the bore is assured over the entire stroke range of the nozzle needle. The nozzle needle has a central longitudinal bore, in which the inner needle is disposed, and the inner needle is fixed relative to the valve body. In particular, the nozzle needle is guided in its end portion toward the valve seat on the inner needle, so that no tilting of the nozzle needle can occur in the region of the valve seat.

In an advantageous feature of the subject of the invention, the inner needle has at least two radially outward-protruding fixation ribs which rest on the inner wall of the bore and thus wedge the inner needle in the bore. This assures easy installation of the inner needle without having to make any structural changes or preparations for receiving the inner needle. It can also be provided that there are more than two fixation ribs, which are then preferably distributed uniformly over the circumference of the inner needle.

In another advantageous feature of the subject of the invention, the inner needle, in its middle region, has an undercut, so that only in an end portion toward the combustion chamber and an end portion remote from the combustion chamber is the nozzle needle is guided on the inner needle. This results in fewer friction losses between the inner needle and the outer needle, and the danger of seizing of the outer needle on the inner needle is reduced.

BRIEF DESCRIPTION OF THE DRAWINGS

Two exemplary embodiments of the fuel injection valve of the invention are described herein below, with reference to the drawings, in which.

DESCRIPTION OF THE PREFERRED EMBODIMENTS

Figure 1:
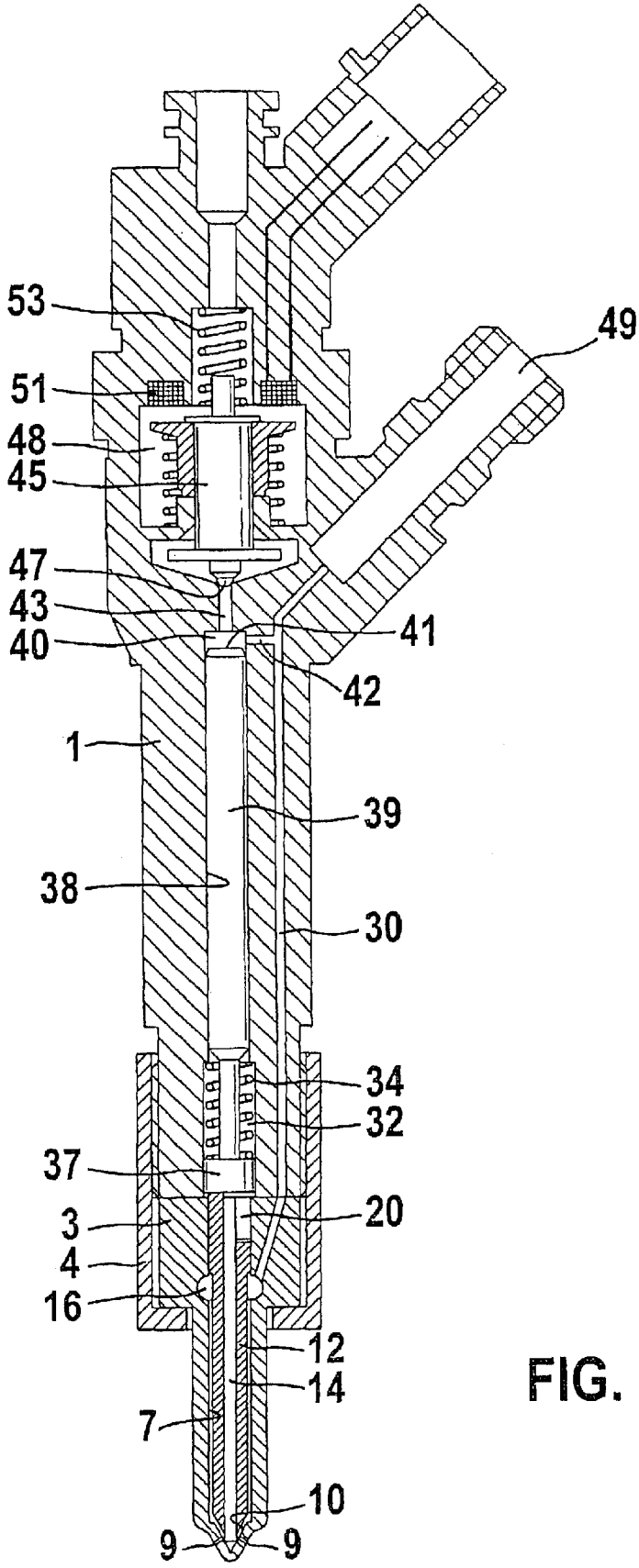
FIG. 1 is a longitudinal section through a fuel injection valve of the invention.
Figure 2:
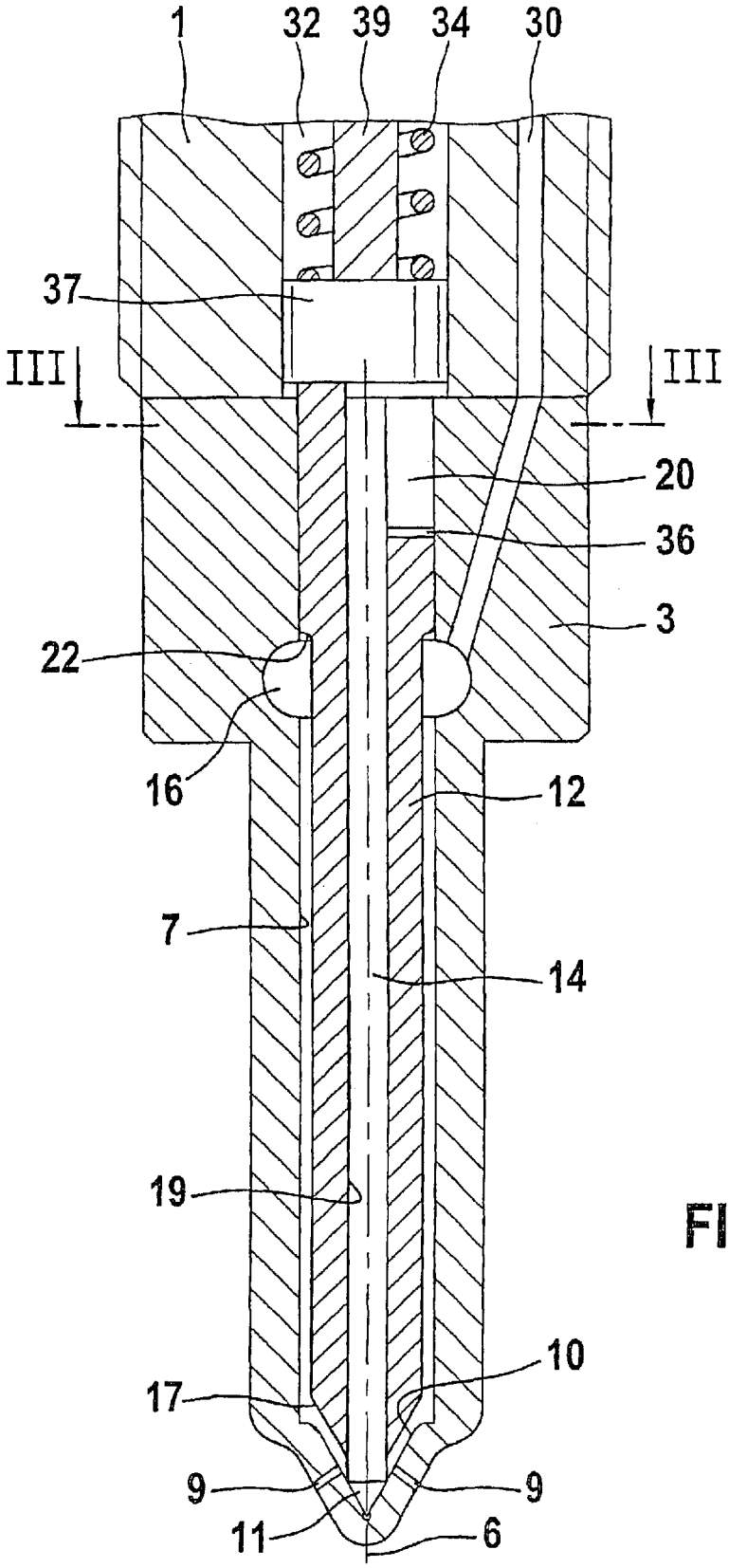
FIG. 2, an enlargement of FIG. 1 in the region of the valve body.
Figure 3:
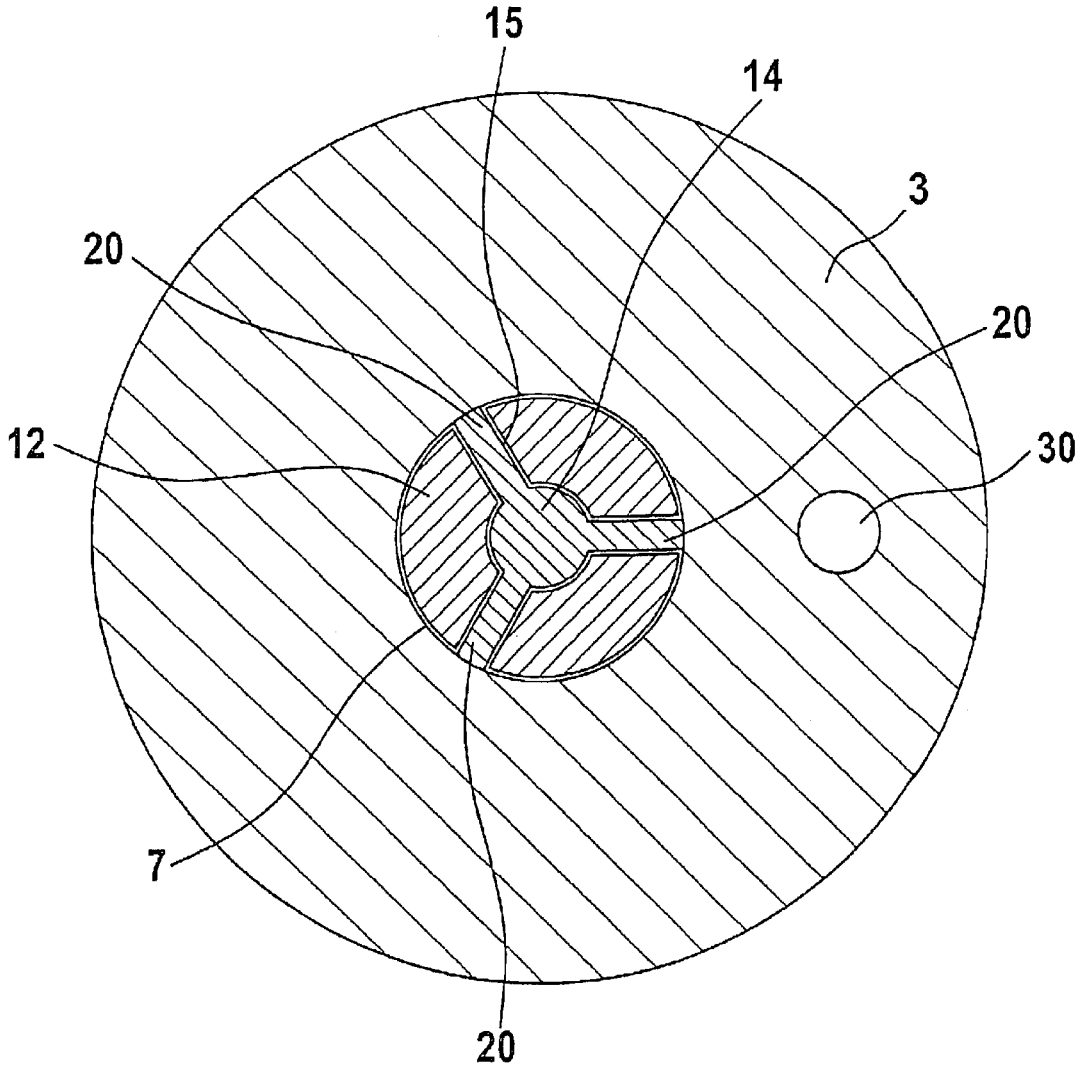
FIG. 3, a cross section through FIG. 2 along the line III—III.

In FIG. 1, a longitudinal section through a fuel injection valve is shown. A valve holding body 1 is braced axially against a valve body 3 by a lock nut 4. A bore 7 is embodied in the valve body 3, and embodied on its end toward the combustion chamber is an essentially conical valve seat face 10, in which there is at least one injection opening 9. A nozzle needle 12 embodied in pistonlike fashion is disposed in the bore 7, and on its end toward the combustion chamber it has a substantially frustoconical valve sealing face 17 which cooperates with the valve seat face 10, so that upon contact of the valve sealing face 17 with the valve seat face 10, the injection openings 9 are closed. The nozzle needle 12 is guided sealingly in the bore 7 in a portion remote from the combustion chamber, and the sealingly guided portion of the nozzle needle 12 has a larger diameter than the portion of the nozzle needle 12 end toward the combustion chamber, so that at the transition, a pressure shoulder 22 is formed. By a radial enlargement of the bore 7 at the level of the pressure shoulder 22, a pressure chamber 16 is formed, which toward the combustion chamber continues in the form of an annular conduit surrounding the nozzle needle 12, extending as far as the valve seat face 10. Via an inlet conduit 30 extending in the valve body 3 and in the valve holding body 1, the pressure chamber 16 communicates with a high-pressure connection 49, by way of which fuel from a high-pressure fuel source, not shown in the drawing, can be pumped into the pressure chamber. In FIG. 2, for the sake of clarity, an enlarged view of FIG. 1 in the region of the valve body 3 is shown, and FIG. 3 shows a cross section through FIG. 2 along the line III—III. The nozzle needle 12 has a central longitudinal bore 19, which acts here as a guide bore and in which an inner needle 14 is disposed. The inner needle 14, on its end toward the combustion chamber, has a contact face 11, which is embodied conically and on which the also conically embodied valve seat face 10 rests. Because of the conical shape of the two faces, the contact face 11 is centrally fixed, so that the end toward the combustion chamber of the inner needle 14 is aligned precisely in the direction of the longitudinal axis 6 of the bore 7. On the end remote from the combustion chamber, the inner needle 14 has three fixation ribs 20, which extend outward radially from the inner needle 14, where they are wedged in the bore 7. The three fixation ribs 20 are distributed uniformly over the circumference of the inner needle 14, so that the inner needle 14 is fixed immovably by the fixation ribs 20 in the valve body 3, precisely in the direction of the longitudinal axis 6 of the bore 7. Provision can also be made for there to be more than three fixation ribs 20 on the nozzle needle 12, which are then likewise preferably distributed uniformly over the circumference of the inner needle 14. The nozzle needle 12 has corresponding recesses 15, which receive the fixation ribs 20 and thus assure the longitudinal displaceability of the nozzle needle 12 on the inner needle 14. Between the end toward the combustion chamber of the fixation ribs 20 and the recess 15, a gap 36 remains, which in the opening position of the nozzle needle as well assures that the nozzle needle 12 will not come to rest on the fixation ribs 20 of the inner needle 14, and thus the inner needle 14 will not be improperly shifted out of its centrally fixed position by being constantly hit by the nozzle needle.

The nozzle needle 12 rests, on its end remote from the combustion chamber, on a cylindrical thrust pad 37, which is disposed in a spring chamber 32 disposed in the valve holding body 1. Between the end remote from the combustion chamber of the spring chamber 32 and the thrust pad 37 is a closing spring 34 prestressed for compression, which via the thrust pad 37 acts on the nozzle needle 12 and thus presses the nozzle needle 12 into its closing position—that is, when the valve sealing face 17 rests on the valve seat face 10. A piston bore 38 is embodied in the valve holding body 1 coaxially with the bore 7 and discharges into the spring chamber 32. A pressure piston 39 is disposed longitudinally displaceably in the piston bore 38 and on its end toward the combustion chamber it protrudes into the spring chamber 32, which it rests on the thrust pad 37 and with its end face 41 remote from the combustion chamber it defines a control chamber 40. The opening stroke of the nozzle needle 12 is stopped here by the impact of the pressure piston on the end remote from the combustion chamber of the piston bore 38. The control chamber 40 communicates via an inlet throttle 42 with the inlet conduit 30 and via an outlet throttle 43 with a leak fuel chamber 48 embodied in the valve holding body 1. This leak fuel chamber 48 communicates with a leak fuel system, not shown in the drawing, and is thus constantly pressureless. A magnet armature 45 is disposed in the leak fuel chamber 48, and a sealing ball 47 is disposed on its end toward the control chamber 40. The magnet armature 45 is urged by a spring 53 in the direction of the control chamber 40, so that the sealing ball 47 is pressed onto the outlet throttle 43 and closes the outlet throttle 43.

In the valve holding body 1, there is an electromagnet 51, surrounding the spring 43, which when suitably supplied with current exerts an attracting force on the magnet armature 45, thus pulling it in the direction of the electromagnet 51, counter to the force of the spring 53, so that the sealing ball 47 uncovers the outlet throttle 43. If no current is supplied to the electromagnet 51, the spring 53 presses the magnet armature 45 and thus the sealing ball 47 back onto the outlet throttle and thus closes off the control chamber 40 from the leak fuel chamber 48.

The mode of operation of the fuel injection valve is as follows: Via the high-pressure connection 49, fuel under high pressure is constantly carried as far as the inside of the pressure chamber 16, so that a constant, predetermined high fuel pressure prevails in the pressure chamber 16. The result is a hydraulic force on the pressure shoulder 22 of the nozzle needle 12 that is oriented in the direction of the thrust pad 37. If no injection is meant to take place, then no current is supplied to the electromagnet 51, and thus the outlet throttle 43 is closed by the sealing ball 47. As a result, because of the inlet throttle 42, the same pressure prevails in the control chamber 40 as in the inlet conduit 30 or in the pressure chamber 16, resulting in a corresponding hydraulic force on the end face 41, remote from the combustion chamber, of the pressure piston 39. Since the pressure piston 39 has a larger diameter, and thus a larger hydraulically effective surface area, than the shoulder 22 on nozzle needle 12, the force exerted by the pressure piston 39 on the nozzle needle 12 via the thrust pad 37 predominates, and thus the nozzle needle 12 stays in the closing position and closes the injection openings 9. If an injection is to occur, then the electromagnet 51 is supplied with current, and the magnet armature 45 moves in the direction of the electromagnet 51. As a result, the sealing ball 47 uncovers the outlet throttle 43, and the control chamber 40 is made to communicate with the leak fuel chamber 48. This causes the pressure in the control chamber 40 to drop, so that now the hydraulic force on the pressure shoulder 22 of the nozzle needle 12 predominates, and the nozzle needle lifts from the valve seat face 10 and uncovers the injection openings 9. The closing spring 34 plays only a subordinate role here and serves primarily to keep the nozzle needle in the closed position when the fuel injection system has been shut off. If the injection is to be terminated, the electromagnet 51 is switched to be without current, and the high fuel pressure of the inlet conduit 30 builds up again in the control chamber 40.

In installing the nozzle needle 12 and the inner needle 14 in the bore 7, the procedure is for instance as follows; The inner needle 14 is introduced into the nozzle needle 12, and then the two are introduced jointly into the bore 7. The annular ribs 20 of the inner needle 14 are embodied here such that they have to be pressed into the bore 7, resulting in an immovable fixation of the inner needle 14 in the bore 7 along the longitudinal axis 6 thereof. The nozzle needle 12 need not be fixed any further, because it is unambiguously disposed in the bore 7 by the fixation of the inner needle 14. Next, the valve holding body 1, with the pressure piston 39 already disposed in it and with the closing spring 34 and the thrust pad 37, is braced against the valve body 3 by means of the lock nut 4.

Figure 4:
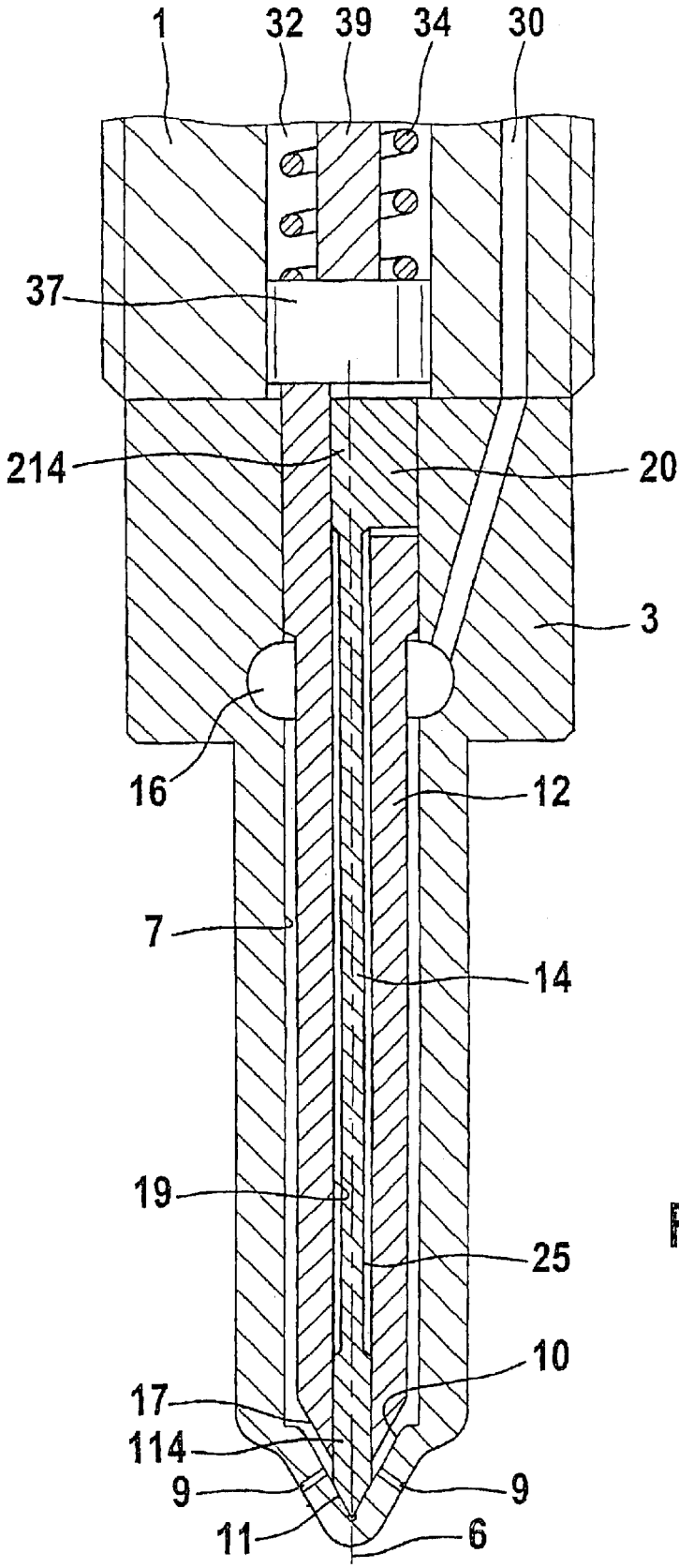
FIG. 4, an enlargement of FIG. 1 in the region of the valve body of a further exemplary embodiment.

In FIG. 4, a further exemplary embodiment of the fuel injection valve of the invention is shown. Here, the inner needle 14 does not have a constant outer diameter; instead, between a first guide portion 114 toward the combustion chamber and a second guide portion 214 remote from the combustion chamber, it has an undercut 25, in the vicinity of which the outer diameter of the inner needle 14 is reduced. The nozzle needle 12 is guided only over the first guide portion 114 and the second guide portion 214, thus lessening the danger of seizing of the nozzle needle 12 on the inner needle 14, and reducing both wear and friction of the nozzle needle 12 on the inner needle 14. Provision can also be made to omit the second guide portion 214; then the nozzle needle 12 is guided on the inner needle 14 only over the first guide portion 114. The nozzle needle 12 is already guided sealingly on its outer jacket face in the portion of the bore remote from the combustion chamber, and so guidance of the nozzle needle 12 on the inner needle 14 in this region is not absolutely necessary, depending on the demands made of the fuel injection valve.

The foregoing relates to preferred exemplary embodiments of the invention, it being understood that other variants and embodiments thereof are possible within the spirit and scope of the invention, the latter being defined by the appended claims.

We claim:

1. A fuel injection valve for internal combustion engines, the valve comprising a valve body (3) in which a bore (7) is embodied, on the end of which bore a valve seat face (10) and at least one injection opening (9) are embodied, which injection opening (9) connects the bore (7) with the combustion chamber of the engine, a nozzle needle (12), which is longitudinally displaceable in the bore (7) and on its end toward the combustion chamber has a sealing face (17) which cooperates with the valve seat face (10) and thus controls the at least one injection opening (9), a central longitudinal bore (19) in the nozzle needle (12), and an inner needle (14) disposed in the central longitudinal bore (19), the inner needle (14) being fixed immovably relative to the valve body (3), and the nozzle needle (12) being guided over at least part of its length on the inner needle (14), wherein the inner needle (14) comprises at least two radially outward-protruding fixation ribs (20), which rest on the inner wall of the bore (7) and thus wedge the inner needle (14) in the bore (7).

2. The fuel injection valve of claim 1 wherein the fixation ribs (20) are disposed in the end remote from the combustion chamber of the inner needle (14).

3. The fuel injection valve of claim 1 wherein the fixation ribs (20) are distributed uniformly over the circumference of the inner needle (14).

4. The fuel injection valve of claim 1 wherein the nozzle needle (12), at least on its end toward the combustion chamber, is guided on the inner needle (14).

5. The fuel injection valve of claim 1 wherein the inner needle (14) has an undercut (25).

6. The fuel injection valve of claim 1 wherein, in an end portion toward the combustion chamber, the nozzle needle (12) is guided on the inner needle (14), and in an end portion remote from the combustion chamber it is guided in the bore (7).

* * * * *